US006568531B2

(12) United States Patent
Johnson

(10) Patent No.: US 6,568,531 B2
(45) Date of Patent: May 27, 2003

(54) SANDPAPER INDEX FILE FOR EASE OF STORAGE

(76) Inventor: Donald E. Johnson, 404 Sagecrest Dr., San Antonio, TX (US) 78232

( * ) Notice: Subject to any disclaimer, the term of this patent is extended or adjusted under 35 U.S.C. 154(b) by 0 days.

(21) Appl. No.: 10/053,121

(22) Filed: Jan. 23, 2002

(65) Prior Publication Data

US 2002/0168487 A1 Nov. 14, 2002

Related U.S. Application Data

(60) Provisional application No. 60/274,844, filed on Mar. 9, 2001.

(51) Int. Cl.[7] ..... B65D 85/62

(52) U.S. Cl. ..... 206/449; 211/50; 220/529; 283/37; 283/39

(58) Field of Search ..... 428/98, 34.1; 206/449; 211/50; 40/380; 220/529; 283/36, 37, 39

(56) References Cited

U.S. PATENT DOCUMENTS

D322,989 S 1/1992 Wood ..... D19/75

D370,806 S 6/1996 Sklovsky ..... D6/510

OTHER PUBLICATIONS

American Woodworker Jun. 1995 Green—Filing Sandpaper—p. 24.

Hands On Magazine Sep./Oct. 1984 Johnson—Sandpaper File—p. 14.

*Primary Examiner*—Alexander S. Thomas

(57) ABSTRACT

A box for storing sandpaper sheets, open at the front and top, and containing a series of indexing dividers with integral tabs annotated with appropriate sandpaper grit sizes. At the aft portion of the index divider are two lateral tabs which project outward and are retained in a vertical groove along the right and left sides of the box. The lateral tabs prevent the index dividers from sliding forward and allow the index dividers to ride up or down in the vertival slots as the stack of sandpaper sheets changes. The lateral tabs function as a unique lifting mechanism to permit the index divider to be raised enough to provide ample clearance to easily insert or remove a sheet of sandpaper. When the index divider is lowered into place it compresses all sandpaper sheets below it to keep the sandpaper sheets from curling.

1 Claim, 4 Drawing Sheets

SANDPAPER INDEX FILE FOR EASE OF STORAGE

CROSS REFERENCES TO RELATED APPLICATION

This application is entitled to the benefit of Provisional Patent Application Serial No. 60/274,844 filed Mar. 9, 2001.

BACKGROUND

1. Field of Invention

This invention relates to storage containers; specifically, to an improved method of storing and retrieving sandpaper sheets.

2. Discussion of Prior Art

Sheets of sandpaper used in the shop rarely get stored properly and, if they do get stored at all, it becomes a chore to find and retrieve a sheet of the desired grit size. Sheets are usually stored in the carton or package in which they are purchased, or stored in a shop drawer. Consequently, they also have a tendency to curl, which becomes an additional irritant to the user.

Several attempts to correct some of these problems have been made, none of which completely addressed the issues of convenient storage, easy retrieval, proper indexing, prevention of curling of sheets, and occupying minimum space.

U.S. Pat. No. Des. 370,806 to Sklovsky (1996) discloses a simple tray arrangement, similar in appearance to a desk-type in-basket, which is used for storing sandpaper. The main feature indicates that the trays can be stacked in a vertical arrangement. While functional, these trays must be used in quantity if they are to be used for storage and easy retrieval of various grit sizes of sandpaper, which unneedlessly consumes storage space and becomes expensive to implement. The problem of curling of the sandpaper sheets is not resolved by this design or arrangement.

U.S. Pat. No. Des. 322,989 to Wood (1992) discloses a storage container intended for cards, but which could also be used for the storage of sandpaper sheets. It consists of a compartmentalized and wide horizontal tray which uses vertical dividers for sorting cards of various types. Use of this storage container for sandpaper sheets raises the same concerns as for Sklovsky, described above.

American Woodworker Magazine, Issue 45, June 1995, describes on page 24 a device by Tim Green for filing sandpaper sheets and keeping them flat by use of a weight. The storage and retrieval of the sandpaper sheets becomes cumbersome. As sheets are added or removed using this arrangement, the entire stack is prone to sliding and slipping since the design lacks adequate means to retain the dividers in place. Storing or retrieving a single sheet from the bottom of the stack is difficult because the entire stack must be lifted in the process since the design lacks any type of lifting mechanism.

Hands On Magazine, September/October 84, by Shopsmith, Inc., has a photograph shown on Page 14 of a sandpaper organizer which I had built and submitted to the magazine. This was my invention for which I had intended to apply for a patent. However, because of a lack of adequate finances, lack of knowledge of the patent procedures, and a lack of adequate time to pursue the project, it was set aside for the proper moment. I never abandoned the goal of having my invention patented and, following retirement, I decided to further refine and finalize my invention for submittal of a patent application.

SUMMARY

In accordance with the present invention a box comprises a container having two sides, bottom, back, open at the top and front, and having approximately eight rigid index dividers which have lateral tabs at the rear fitting into vertical slots at the rear of each box side.

Objects and Advantages

Objects and advantages of the present invention are:

(a) to provide a container for storage of sandpaper sheets;

(b) to sort sandpaper sheets by grit size;

(c) to prevent sandpaper sheets from curling due to environmental factors;

(d) to provide easy storage of sandpaper in separated compartments;

(e) to provise easy access for retrieval of sandpaper sheets;

(f) to provide means of removing a single sheet from a stack of sheets;

(g) to provide a storage container which is compact and space saving;

(h) to provide a storage container which is simple to use;

(i) to provide a storage container which can be constructed of readily available materials; and (j) to provide a storage container which is economical to produce for the mass public.

Simplicity in design and construction serves to make the use and operation of the storage container rather obvious to the person using it. The storage container can be manufactured from a variety of materials including, but not limited to, metal, plastic and associated compounds, wood, or cardboard. The storage container is intended for use by the hobbyist, small shop operator, or commercial industry. Additional objects and advantages will become readily apparent from a consideration of the ensuing drawings and description.

DRAWING FIGURES

REFERENCE NUMERALS IN DRAWINGS

Figure 1:
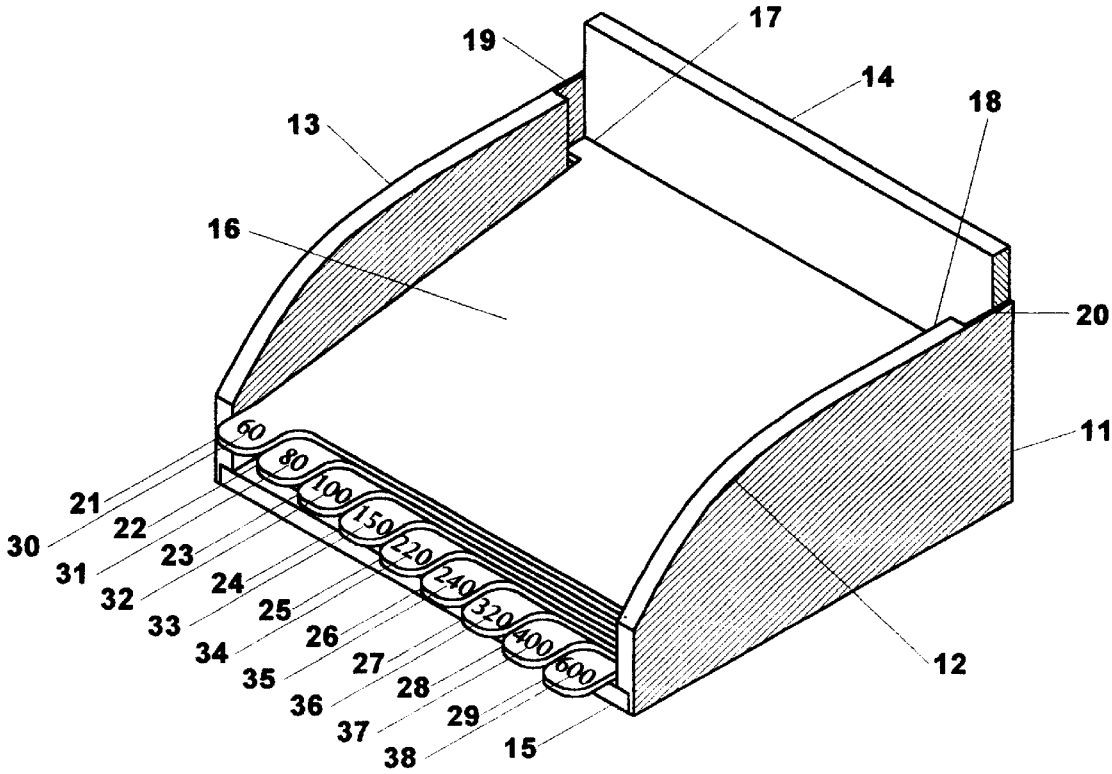
FIG. 1 is a perspective view of the right side of a sandpaper index file constructed in accordance with the invention.

| | |
|---|---|
| 11 sandpaper index file | 12 right side |
| 13 left side | 14 back |
| 15 base | 16 index divider |
| 17 lateral tab, left | 18 lateral tab, right |
| 19 retainer track, left | 20 retrainer track, right |
| 21 index tab | 22 index tab |
| 23 index tab | 24 index tab |
| 25 index tab | 26 index tab |
| 27 index tab | 28 index tab |
| 29 index tab | 30 number |
| 31 number | 32 number |
| 33 number | 34 number |
| 35 number | 36 number |
| 37 number | 38 number |
| 39 index divider A | 40 lateral tab, left |
| 41 lateral tab, right | 42 index divider B |

-continued

| REFERENCE NUMERALS IN DRAWINGS | |
|---|---|
| 43 lateral tab, left | 44 lateral tab, right |
| 45 strap | 46 fastener |
| 47 fastener | 48 fastener |
| 49 index divider C | 50 lateral tab, left |
| 51 lateral tab, right | 52 clip |

DESCRIPTION

FIG. 1—Sandpaper Index File

FIG. 1 is a perspective view taken from the viewer's right side of a sandpaper index file 1 constructed in accordance with the invention. There are two sides 12 and 13, a back 14, and a base 15 which are assembled to comprise the box-like structure. A series of index dividers 16 fit inside the sandpaper index file 11 and are retained from slipping forward by a lateral tab 17 and 18 located at the right hand and left hand rear edge of each index divider 16. Each lateral tab 17 and 18 fits into, and rides along, a retainer track 19 and 20 which is cut out as a slot running vertically at the rear edge of each side 12 and 13. Each index divider 16 has an index tab 21, repeated at locations 22, 23, 24, 25, 26, 27, 28, and 29. The locations of the index tabs on the index dividers are offset from one another for readability of the numbers 30, 31, 32, 33, 34, 35, 36, 37, and 38 which correspond with a grit size for the sandpaper. The grit size numbers can be in the form of engraved, printed, painted, decals, or glued-on numbers. The user will decide which numbers are appropriate for his/her application.

Figure 2:
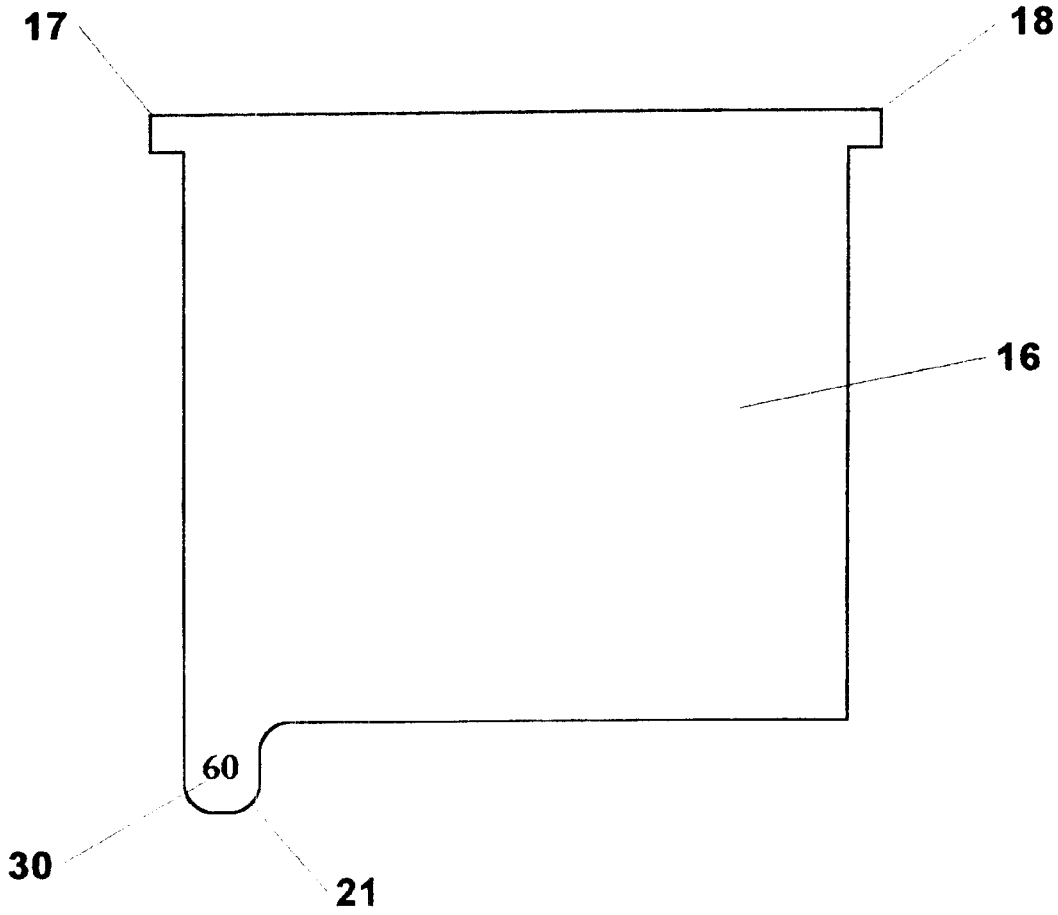
FIG. 2 is a perspective top view of one of the index dividers of the sandpaper index file of FIG. 1.

FIG. 2—Typical Index Divider

FIG. 2 is a perspective view of the top of an index divider 16 which shows the lateral tabs 17 and 18, the index tab 21, and the number 30, which, in this case, corresponds to a sandpaper grit size of 60. The lateral tabs 17 and 18 function as a unique lifting device which allows the index divider 16 to be lifted clear of the sandpaper sheets and prevents the sandpaper sheets from clinging together because of the abrasive grit on the sandpaper.

Figure 3:
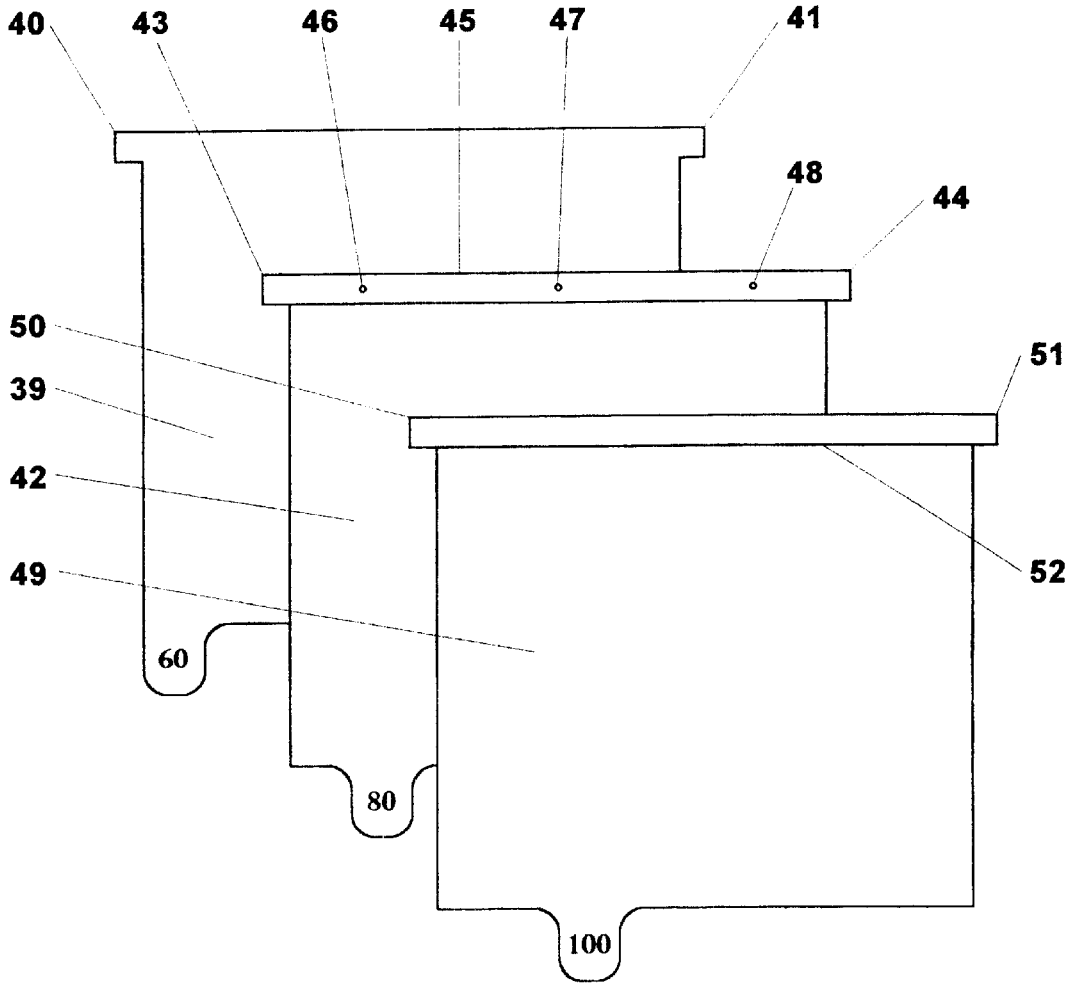
FIG. 3 is a perspective view of several different possible configurations of the index dividers of the sandpaper index file of FIG. 1.

FIG. 3—Index Divider Configurations

FIG. 3 is a perspective view of several index dividers 16 to show various construction configurations possible for the lateral tabs 17 and 18. In this view, index divider A 39 has the lateral tabs 40 and 41 formed as an integral part of the index divider. Index divider B 42 has the lateral tabs 43 and 44 as a part of a strap 45 which has been added to the index divider B 42 and secured in place with a series of fasteners 46, 47, and 48. Index divider C 49 has the lateral tabs 50 and 51 as a part of a clip 52 which has been affixed to the rear of the index divider C 49 and secured by compression or adhesive.

Figure 4:
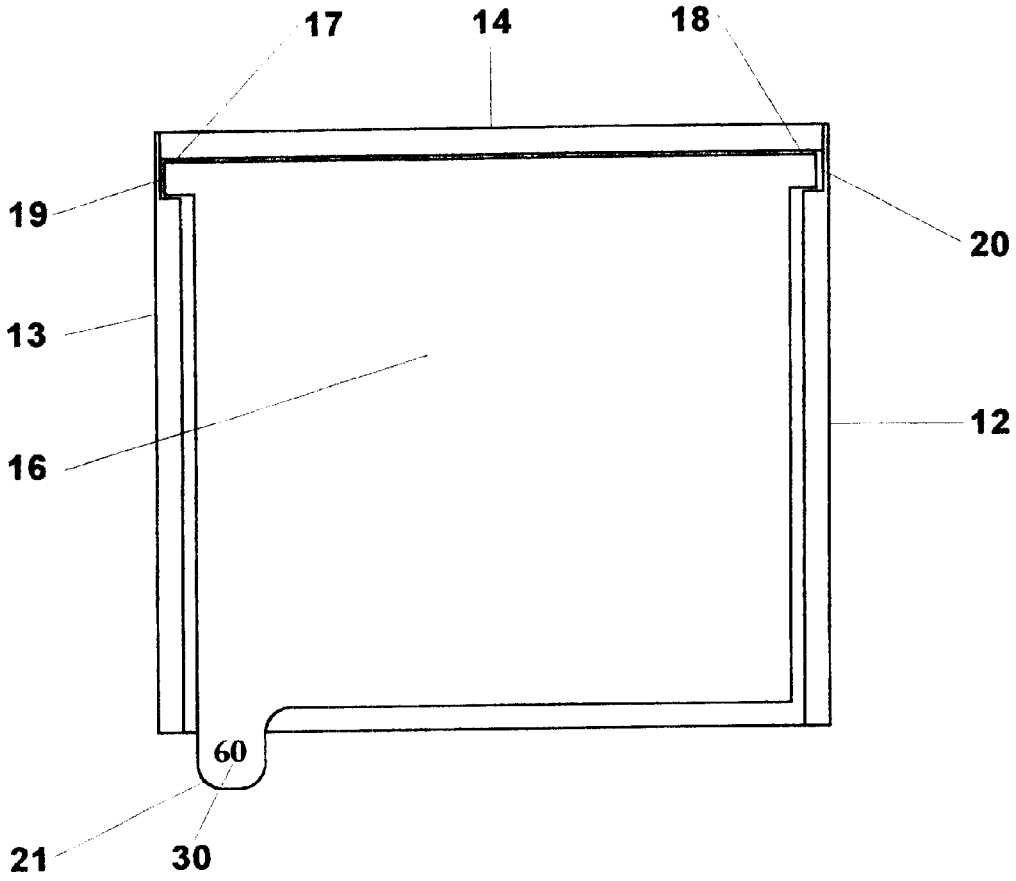
FIG. 4 is a perspective view looking down at the top of the sandpaper index file of FIG. 1 to show how the index dividers are held in place.

FIG. 4—Top View of Sandpaper Index File

FIG. 4 is a perspective view of the top with the user looking down from above at the sandpaper index file 11 showing a typical index divider 16 in place and being retained by the lateral tabs 17 and 18 held in place by the retrainer tracks 18 and 19. The lateral tabs 17 and 18, along with the index divider 16, are free to ride up and down vertically in the retainer tracks 18 and 19.

Advantages

From the description above, a number of advantages of my sandpaper index file become evident:

(a) Loose sheets of sandpaper are neatly stored in a compact container which consumes a minimum of valuable space in the shop or factory.

(b) The sandpaper index file may be hung on a wall or placed on a table, shelf, or workbench.

(c) Sandpaper sheets are stored by their grit size using index dividers which are labeled with the appropriate grit size.

(d) When sandpaper sheets are inserted or removed, a unique lifting device at the rear of each index divider raises the sandpaper stack to allow the individual sheets to be inserted or removed without dragging other sheets in the process.

(e) The entire stack of sandpaper and index dividers expands or contracts vertically as sandpaper sheets are inserted or removed.

(f) Use of the index dividers prevents sandpaper sheets from curling due to environmental conditions.

(g) Sandpaper discs and sandpaper sheets less than full size may be stored without causing the entire stack to slip or shift.

(h) Sandpaper sheets which have been used sparingly and are still usable may be placed back into the sandpaper index file and stored for future use.

(i) The sandpaper index file can be constructed from a variety of materials depending upon manufacturer preference.

(j) The sandpaper index file can be mass produced and made available to the user at a reasonable and economical cost.

(k) Although FIG. 1 shows nine index dividers, any reasonable number may be employed, and additional index dividers may be added as desired.

Operation

In operation, the user uses the sandpaper index file 11 the same way that one would use any index file. Find the desired sandpaper grit size number 30–38 annotated on the apropriate index tab 21–29, lift the index tab and insert (or remove) the sandpaper sheet. When the index divider 16 is raised, the action of the lateral tabs 17 and 18 comprise a unique lifting mechanism which causes the aft portion of the index divider 16 to be raised enough to provide ample clearance to easily insert or remove a sheet of sandpaper. When the index divider 16 is lowered back into place, it compresses all sandpaper sheets below it and prevents any curling action from taking place.

Conclusion, Ramifications, and Scope

Accordingly, the reader will readily see that the sandpaper index file may be used to conveniently store individual sandpaper sheets, while separating them according to grit size. The sandpaper sheets are easily and quickly stored or removed without disturbing other sheets in the stack, ending the frustrating practice of spilling sandpaper sheets onto the floor when trying to remove a single sheet from its original package. The capability to store partially used sheets of sandpaper easily and readily available by grit size represents a major advantage since it precludes the sheets from becoming lost, damaged, or curled. The sandpaper index file will prevent sandpaper sheets from curling caused by environmental conditions.

Sequence Listing

Not applicable.

I claim:

1. A storage file for sandpaper sheets comprising:

(a) a box consisting of two sides, bottom, and back, without a front and open at the top, and (b) each of said sides having a slot on its inner surface approximately one inch wide and approximately three-eighths inch deep beginning at said bottom and adjacent to said back and running the entire height of said back, and (c) said box containing a plurality of flat sheets of rigid material which lie in a horizontal plane within said box with sufficient clearance to permit said flat sheets of rigid material to be raised vertically within said box, and (d) each said flat sheet of rigid material having a tab approximately three-fourths inch wide extending from each side edge laterally for approximately three-eighths inch and capable of fitting within said slot in each said side, and (e) each said flat sheet of rigid material additionally having an index tab approximately one and one-quarter inch long and protruding forward from each said flat sheet of rigid material for a length of approximately one and one-half inch, and (f) each said index tab positioned adjacent to said index tab of the said flat sheet of rigid material stacked below it, and (g) each said index tab annotated with a number to designate a sandpaper grit size.

* * * * *